US012173578B2

(12) United States Patent
Karegaonkar et al.

(10) Patent No.: US 12,173,578 B2
(45) Date of Patent: Dec. 24, 2024

(54) HANGER RUNNING TOOL AND A METHOD FOR INSTALLING A HANGER IN A WELL

(71) Applicant: AKER SOLUTIONS AS, Lysaker (NO)

(72) Inventors: Sachin Karegaonkar, Aros (NO); Andy Dyson, Stonehaven (GB)

(73) Assignee: AKER SOLUTIONS AS, Lysaker (NO)

( * ) Notice: Subject to any disclaimer, the term of this patent is extended or adjusted under 35 U.S.C. 154(b) by 0 days.

(21) Appl. No.: 18/277,078

(22) PCT Filed: Feb. 15, 2022

(86) PCT No.: PCT/NO2022/050042
§ 371 (c)(1),
(2) Date: Aug. 14, 2023

(87) PCT Pub. No.: WO2022/177444
PCT Pub. Date: Aug. 25, 2022

(65) Prior Publication Data

US 2024/0125193 A1 Apr. 18, 2024

(30) Foreign Application Priority Data

Feb. 16, 2021 (GB) ..... 2102145
Jul. 21, 2021 (GB) ..... 2110455

(51) Int. Cl.
*E21B 33/04* (2006.01)
*E21B 23/01* (2006.01)
*E21B 33/12* (2006.01)

(52) U.S. Cl.
CPC ..... *E21B 33/04* (2013.01); *E21B 23/01* (2013.01); *E21B 33/12* (2013.01)

(58) Field of Classification Search
CPC ..... E21B 33/04; E21B 33/12; E21B 23/01
USPC ..... 166/377
See application file for complete search history.

(56) References Cited

U.S. PATENT DOCUMENTS

2016/0177652 A1 6/2016 Thornburrow
2016/0222748 A1* 8/2016 Van Bilderbeek ..... E21B 23/04
2018/0100364 A1 4/2018 Nguyen
2018/0179839 A1 6/2018 Nguyen
2018/0187502 A1 7/2018 Cridland et al.
2018/0258726 A1 9/2018 Levert, Jr. et al.
(Continued)

*Primary Examiner* — Taras P Bemko
(74) *Attorney, Agent, or Firm* — Norman B. Thot

(57) ABSTRACT

A hanger running tool for installing a hanger in a well. The hanger running tool includes a central bore, a hanger engagement arrangement having an engaged position in which the hanger engagement arrangement is coupled to the hanger and a disengaged position in which the hanger engagement arrangement is decoupled from the hanger, and a pressure-controlled anchoring actuator which actuates an anchoring arrangement. The pressure-controlled anchoring actuator has an actuation surface. The hanger engagement arrangement has the engaged position in response to an increase in a pressure at a first pressure source, and the disengaged position in response to an increase in a pressure inside the central bore. The pressure-controlled anchoring actuator is actuated in response to an increase in a pressure on the actuation surface so that the anchoring arrangement anchors the hanger to an anchor point.

20 Claims, 4 Drawing Sheets

(56) References Cited

U.S. PATENT DOCUMENTS

2018/0258727 A1 9/2018 Lim et al.
2021/0131227 A1* 5/2021 Gharesi ..... E21B 34/142

* cited by examiner

Detail A

Detail B

HANGER RUNNING TOOL AND A METHOD FOR INSTALLING A HANGER IN A WELL

CROSS REFERENCE TO PRIOR APPLICATIONS

This application is a U.S. National Phase application under 35 U.S.C. § 371 of International Application No. PCT/NO2022/050042, filed on Feb. 15, 2022 and which claims benefit to Great Britain Patent Application No. 2102145.6, filed on Feb. 16, 2021, and to Great Britain Patent Application No. 2110455.9, filed on Jul. 21, 2021. The International Application was published in English on Aug. 25, 2022 as WO 2022/177444 A1 under PCT Article 21(2).

FIELD

The present invention relates to a hanger running tool for installation of a hanger in a wellbore and a method for installing a hanger in a well.

BACKGROUND

In the field of subsea oil and gas wells, the installation of a hanger (e.g., a tubing hanger or a casing hanger) is commonplace. The hanger is used in the completion of oil wells and is used to suspend tubing or casing from the wellhead.

Installation or retrieval of a hanger is normally performed using a tubular riser inside the marine riser and Blow Out Preventer (BOP). Installation and retrieval of a hanger is performed using a hanger running tool, which is able to be connected to the hanger, thereby allowing installation or retrieval.

The control of a Hanger Running Tool (HRT) and associated downhole functions is presently achieved through a hanger umbilical clamped to the tubular (e.g., subsea riser, control riser etc.). Such a setup requires a huge investment to establish, as well as a large amount of rig space and operational expenses. Several activities and processes must also be carried out during installation, e.g., handling umbilical, clamping umbilical to a riser at regular intervals etc.

With the necessary equipment in place, the HRT is then required to be positioned and controlled in a subsea environment. Using the presently available technology, the HRT is operated by supplying operating fluid via a topside HPU and umbilical or via a subsea control module, both of which require a dedicated power source for providing a supply of hydraulic fluid as necessary for operation. As well as being expensive and sophisticated to install and operate (e.g., due to the equipment involved and/or the need to separately generate a high-pressure source of hydraulic fluid), there is always a risk that the hydraulic line may rupture and leak hydraulic fluid into the subsea environment, or that some other component may fail. Current systems may give rise to environmental concern, and additional measures may need to be taken in order to safeguard against this happening.

There is therefore a requirement for a way to control the installation of a hanger in a subsea environment which is less cost intensive, requires less complex and sophisticated equipment, and which is more environmentally friendly than known methods.

SUMMARY

An aspect of the present invention is to mitigate, alleviate or eliminate one or more of the above-identified deficiencies and disadvantages in the prior art and to solve at least the above-mentioned problem.

In an embodiment, the present invention provides a hanger running tool for installing a hanger in a well. The hanger running tool includes a central bore, a hanger engagement arrangement which is configurable between an engaged position in which the hanger engagement arrangement is coupled to the hanger, and a disengaged position in which the hanger engagement arrangement is decoupled from the hanger, and a pressure-controlled anchoring actuator which is configured to actuate an anchoring arrangement. The pressure-controlled anchoring actuator comprises an actuation surface. The hanger engagement arrangement is configurable to the engaged position in response to an increase in a pressure at a first pressure source. The hanger engagement arrangement is configurable to the disengaged position in response to an increase in a pressure inside the central bore. The pressure-controlled anchoring actuator is actuated in response to an increase in a pressure on the actuation surface so that the anchoring arrangement anchors the hanger to an anchor point.

BRIEF DESCRIPTION OF THE DRAWINGS

The present invention is described in greater detail below on the basis of embodiments and of the drawings in which.

DETAILED DESCRIPTION

Figure 1:
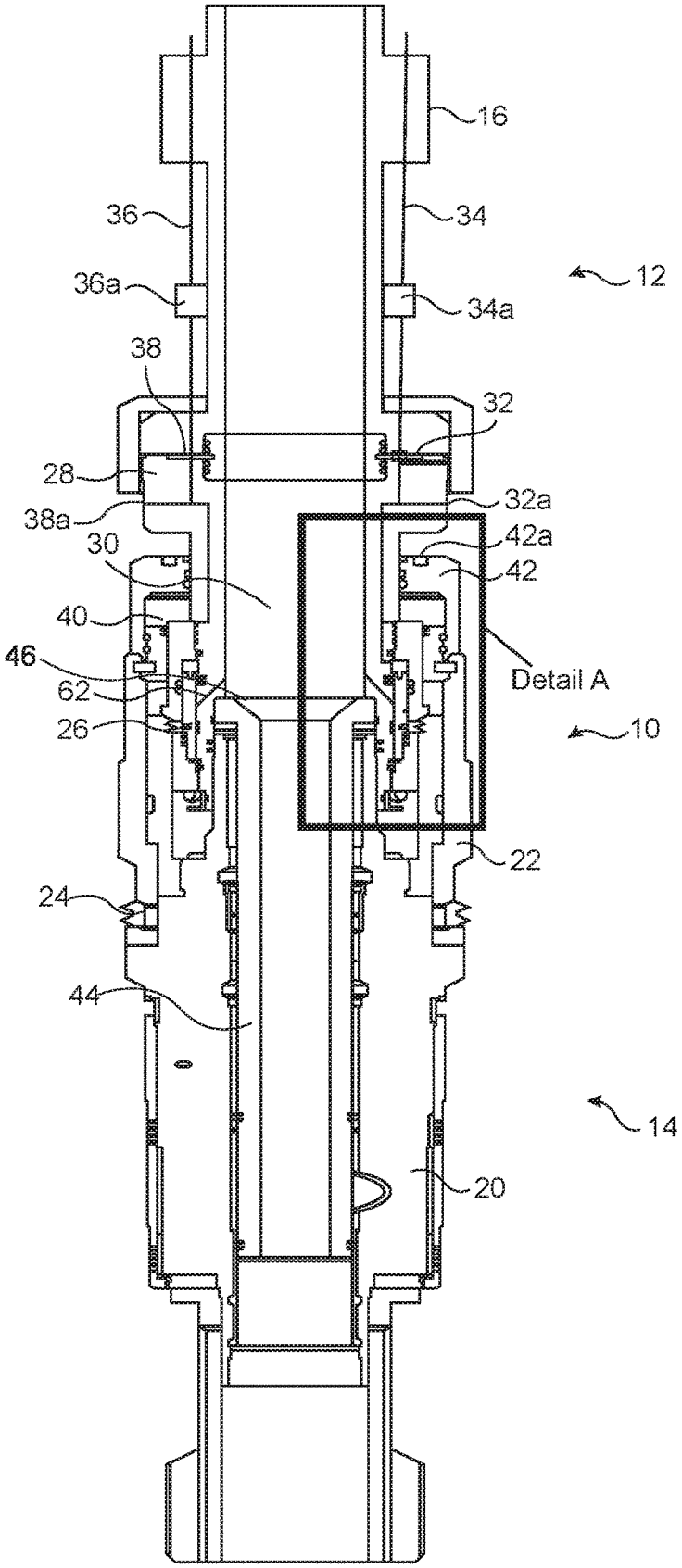
FIG. 1 shows a sectional view of an example of the hanger running tool in an installation configuration.

According to a first aspect, the present invention provides a hanger running tool for installation of a hanger in a well, comprising: a central bore; a hanger engagement arrangement configurable between an engaged position in which the engagement arrangement is coupled to a hanger, and a disengaged position in which the engagement arrangement is decoupled from a hanger; a pressure-controlled anchoring actuator for actuating an anchoring arrangement, and comprising an actuation surface; the hanger engagement arrangement being configurable to the engaged position in response to an increase in pressure at a first pressure source, being configurable to the disengaged position in response to an increase in pressure inside the central bore, and the anchoring actuator being actuated in response to an increase in pressure on the actuation surface (e.g., an increase in pressure external to the tubing hanger running tool, such as an increase in the pressure in the BOP, below the slick joint) so that the anchoring arrangement anchors the hanger to an anchor point (e.g., which may be located on the wellhead, the Xmas tree, the BOP, or the like).

The hanger running tool may be a running tool for any type of hanger, for example, for a tubing hanger, or for a casing hanger.

The first pressure source may be the pressure inside the central bore, or may be an external pressure source located at a surface location. In the case where the pressure source is located at a surface location, the pressure increase may be applied by the external pressure source while the hanger running tool is also located at the surface location. According to a second example, the hanger running tool may be configurable to be located inside at least one of a BOP, a subsea Xmas tree and a wellbore, and the anchoring actuator may be configurable to be actuated in response to an increase in pressure inside the BOP, subsea Xmas tree or wellbore, thereby resulting in an increase in pressure on the actuation surface. The anchoring actuator may be located on an external surface of the tool.

According to a third example, the first pressure source may be generated by a pump or compressor. The first pressure source may be generated while the tool is located at the surface location, and the first pressure source may be connected to the hanger running tool while the hanger running tool is at the surface location. The first pressure source may be located at a surface location.

According to a fourth example, the hanger engagement arrangement may be configurable to be disconnected from the first pressure source prior to the hanger running tool being positioned in a well.

According to a fifth example, the hanger engagement arrangement and the anchoring actuator may be located external to and around the periphery of the central bore.

According to a sixth example, the tool may comprise a pressure sealing arrangement which is configurable to be positioned in the central bore to enable an increase in pressure in the central bore above the sealing object. The pressure sealing arrangement may, for example, be a sleeve and actuation object, or a plug.

According to a seventh example, the sealing object may provide a first pressure region and a second pressure region in the central bore.

According to an eighth example, the tool may comprise a valve comprising a valve seat located in the central bore, the valve being closeable to increase the pressure inside the hanger running tool.

According to a ninth example, the valve may be at least one of a ball valve or a valve that is activated by an activation object.

According to a tenth example, the valve may be removable from the hanger running tool. The valve seat may be removable from the hanger running tool in some examples.

According to an eleventh example, the hanger engagement arrangement may comprise an actuator, the actuator being configurable to be in pressure communication with a first pressure source and configurable to be in pressure communication with the central bore.

According to a twelfth example, the hanger engagement arrangement may comprise an actuator comprising a first and a second pressure inlet, the first pressure inlet being in communication with the first pressure source via the first pressure conduit, and the second pressure inlet being open to the pressure in the central bore via the channel.

According to a thirteenth example, the hanger engagement arrangement may comprise an actuator comprising a piston contained in a hydraulic chamber arrangement divided into an upper hydraulic chamber and a lower hydraulic chamber, both the first pressure source and the central bore being in pressure communication with a hydraulic chamber of the hydraulic chamber arrangement.

According to an fourteenth example, the first pressure source may be in pressure communication with the upper hydraulic chamber located at an upper end of the hydraulic chamber arrangement, and the central bore may be in pressure communication with the lower hydraulic chamber located at a lower end of the hydraulic chamber arrangement, so that an increase in pressure from the first pressure source may act to move the piston in a first direction, and so that an increase in pressure from the central bore may act to move the piston in a second direction.

According to a fifteenth example, the anchoring actuator may be in the form of an annular piston.

According to a sixteenth example, the tool may comprise an anchoring arrangement comprising an anchor engagement profile, the anchoring actuator being configurable to operate the anchoring arrangement to engage the wellbore.

According to a seventeenth example, the tool may comprise a locking arrangement which is configured to lock the hanger engagement arrangement in the engaged position.

According to an eighteenth example, the tool may be configured to retrieve a hanger from a well.

According to a nineteenth example, the tool may comprise a detachable retrieval module for engaging the tool with a hanger for retrieval, the detachable retrieval module comprising a retrieval profile for engaging a hanger for retrieval.

According to a twentieth example, the central bore may be configurable to have a retrievable plug run therethrough.

A second aspect relates to a method for installing a hanger in a well, comprising:

providing a hanger running tool comprising a central bore, a hanger engagement arrangement, and an anchoring actuator for actuating an anchoring arrangement;

engaging the hanger running tool with a hanger by providing an increase in pressure at a first pressure source to configure the hanger engagement arrangement to the engaged configuration, the increase in pressure being provided with both the hanger running tool and the first pressure source being at a surface location;

positioning the hanger and hanger running tool in a well at a desired location;

engaging the hanger with an anchor point by providing an increase in pressure in the well to actuate the anchoring actuator to engage the anchoring arrangement with the anchor point;

disengaging the hanger running tool from the hanger by providing an increase in pressure in the central bore to configure the hanger engagement arrangement to the disengaged configuration; and retrieving the hanger running tool from a well.

According to a second example of the second aspect, the desired location in the well may be at least one of a desired location inside a BOP, a desired location inside a subsea Xmas tree, and a desired location inside a wellbore.

According to a third example of the second aspect, the method may comprise providing a valve seat in the central bore, and locating an activation object (e.g., a ball or dart) in the valve seat to restrict fluid flow therethrough and provide an increase in pressure in the central bore.

According to a fourth example of the second aspect, the method may comprise increasing the pressure in the well to move the anchoring actuator from a first to a second position to engage the anchoring arrangement with the anchor point.

According to a fifth example of the second aspect, the method may comprise attaching a detachable retrieval module to the tool and retrieving the hanger from a well by coupling the detachable retrieval module to the hanger.

According to a sixth example of the second aspect, the method may comprise installing a retrievable plug in the well by running the retrievable plug through the central bore of the tool.

According to a seventh example of the second aspect, the method may comprise performing a well clean-up operation prior to installation of the retrievable plug.

The present disclosure will become apparent from the detailed description given below. The detailed description and specific examples disclose embodiments of the disclosure by way of illustration only. Those skilled in the art understand from guidance in the detailed description that changes and modifications may be made within the scope of the disclosure.

It is therefore to be understood that the herein disclosed disclosure is not limited to the particular component parts of the device described or steps of the methods described since such device and method may vary. It is also to be understood that the terminology used herein is for purpose of describing particular embodiments only and is not intended to be limiting. It should be noted that, as used in the specification and the appended claims, the articles "a", "an", "the", and "said" are intended to mean that there are one or more of the elements unless the context explicitly dictates otherwise. Thus, for example, reference to "a unit" or "the unit" may include several devices, and the like. The words "comprising", "including", "containing" and similar wordings furthermore does not exclude other elements or steps.

The above objects, as well as additional objects, features and advantages of the present invention, will be more fully appreciated by reference to the following illustrative and non-limiting detailed description of example embodiments of the present disclosure, when taken in conjunction with the accompanying drawings.

The present description provides an improved hanger running tool for installation of hanger in wellbore and method for installing hanger in well. According to one example, there is provided a hanger running tool for installation of a hanger in a well, comprising: a central bore; a hanger engagement arrangement configurable between an engaged position in which the engagement arrangement is coupled to a hanger, and a disengaged position in which the engagement arrangement is decoupled from a hanger; a pressure-controlled anchoring actuator for actuating an anchoring arrangement, and comprising an actuation surface; the hanger engagement arrangement being configurable to the engaged position in response to an increase in pressure at a first pressure source, being configurable to the disengaged position in response to an increase in pressure inside the central bore, and the anchoring actuator being actuated in response to an increase in pressure on the actuation surface (e.g., an increase in pressure external to the tubing hanger running tool, so as an increase in the pressure in the BOP, below the slick joint) so that the anchoring arrangement anchors the hanger to an anchor point (e.g., which may be located on the wellhead, the Xmas tree, the BOP, or the like).

In use, the hanger running tool may be able to be coupled, engaged with, or the like to a hanger (e.g., at a surface location), and run into position on a wellhead, a subsea Xmas tree, a wellbore, or the like, and may be run into position, for example, via a Blowout Preventer (BOP) and a marine riser. Once in the desired position, the pressure inside the BOP, marine riser and/or the wellbore may be increased in order to actuate the hanger running tool and provide engagement between the hanger and a component such as a casing hanger seat or the wellhead. The pressure inside the central bore of the hanger running tool may then be increased in order to configure the hanger engagement arrangement to disengage the hanger from the hanger running tool, thereby permitting the hanger running tool to be retrieved from the wellhead, BOP, wellbore, etc., and leaving the hanger in place. This setup permits the user to install the hanger in a desired position without having to have a hydraulic connection between the hanger running tool and a surface location or a subsea control sub/unit, thereby saving on the time and cost of providing the additional equipment involved, as well as running the additional equipment from the surface location. The described system also functions more simply than known systems, and provides environmental benefits, for example, because it removes the risk of there being a leak of hydraulic fluid into the surrounding environment.

Illustrated in FIG. 1 is a cross sectional view of a hanger running tool 10 showing some internal detail thereof. The hanger running tool 10 is coupled at one end to a tubular 12 and at another end to a hanger 14. The hanger 14 is in this case a tubing hanger, however, it should be understood that the hanger running tool 10 may be used to any other type of hanger, such as a casing hanger. Although not illustrated in FIG. 1, the hanger running tool 10 may be run onto a wellhead (e.g., a seat in a casing hanger coupled to a wellhead) or into a subsea Xmas tree or wellbore, for example, via a marine riser and Blowout Preventer (BOP).

In this example, the tubular 12 may be coupled to the hanger running tool 10 by any appropriate means, such as by a flanged and bolted connection, via a threaded connection, or the like. The tubular 12 here comprises a slick joint 16 which may seal with a ram or BOP annular (not illustrated), and which may enable the pressure (e.g., the pressure in the wellbore, BOP, Xmas tree, or the like) to be increased below the slick joint 16 when the ram is in sealing contact therewith.

As will be described in more detail below, the tubing hanger 14 is coupled to the hanger running tool 10, and in FIG. 1, the tubing hanger 14 is illustrated towards the lower portion of FIG. 1. A tubing (which is not illustrated in FIG. 1, located below the tubing hanger 14), such as a production tubing, may be hung from the tubing hanger 14, and the tubing hanger 14 and attached tubing may be run into the desired position in a well with the hanger running tool 10. The tubing hanger 14 comprises a main body portion 20 from which the tubing may be hung, and an actuation sleeve 22. In this example, the actuation sleeve 22 comprises an anchor engagement profile 24 which enables the tubing hanger 14 to engage an anchor point. The anchor point may be located on, for example, a component such as the Xmas tree, wellhead, or a seat in a casing hanger or tubing hanger (not shown).

The hanger running tool 10, which is located between the tubular 12 and the tubing hanger 14, functions to engage the tubing hanger 14 and the attached tubing and permits the tubing hanger 14 to be run into a desired position in relation to a well, such as on a wellhead or Xmas tree. A user may run the hanger running tool 10 into a well through a marine riser and BOP. The hanger running tool 10 is coupled to the tubular 12 via a base component 28, which also defines a central bore 30 within the hanger running tool 10.

In order to attach the tubing hanger 14 to the hanger running tool 10, the hanger running tool 10 comprises a hanger engagement arrangement 26. The hanger engagement arrangement 26 comprises a number of components, which will be described in more detail below and is mounted upon the base component 28. The hanger engagement arrangement 26 is in pressure communication with a first pressure source via a first pressure port 32. In this example, the first pressure port 32 is located in the base component 28, the base component 28 comprising a channel that permits pressure communication between the first pressure port 32 by linking the first pressure port 32 with the hanger engagement arrangement 26. The first pressure port 32 is, in this example, coupled to a first pressure conduit 34, and access to the first pressure port 32 is possible by linking the first pressure port 32 and the first pressure conduit 34. Having access to the first pressure port 32 via the first pressure conduit may provide a user with a degree of flexibility in the provision of pressure at the first pressure port 32, as the first pressure conduit 34 may be routed however necessary in order to provide easy access via a pressure source. The first pressure conduit 34 may therefore permit communication between a first pressure source (not shown) and the hanger engagement arrangement 26 via the first pressure port 32. The first pressure conduit 34 may be attached to a first pressure source, for example, at a surface location, in order to set the hanger engagement arrangement 26 to engage a tubing hanger. The first pressure source may then be disconnected from the first pressure conduit 34 before running the hanger running tool 10 downhole.

As can be seen in this example, the first pressure conduit 34 extends from the first pressure port 32 on the base component 28, and through the slick joint 16, having one end positioned above the slick joint 16. Having the first pressure conduit 34 connected to the first pressure port 32 may therefore provide that, in the case of an increase in pressure below the slick joint, the first pressure port 32 is not exposed to such a pressure increase. The first pressure conduit 34 may have a valve or closure on an open end thereof, thereby providing selective pressure communication to the first pressure port 32. In the example of FIG. 1, the first pressure conduit 34 comprises a valve 34*a* (e.g., a pilot valve) positioned along the length thereof. As will be described in greater detail below, the valve 34*a* may be used to enable a selective venting of a chamber inside the hanger engagement arrangement 26.

Venting through the first pressure conduit 34 may be into the wellbore or, for example, into a BOP.

Although illustrated as a single conduit in FIG. 1 extending through the slick joint 16, the first pressure conduit 34 may be partially defined by the tubular 12 and the slick joint 16, as is illustrated in FIG. 1. The part of the first pressure conduit 34 that is in direct contact with the first pressure port 32 is here defined by a channel in the tubular 12 (in particular, of a flange connection of the tubular 12). The first pressure conduit 34 may be entirely defined by the channel in the tubular 12, and the channel need not contain any tubing therein. The conduit is then defined by a first section of tubing between the channel defined in the tubular 12 and the slick joint 16. The slick joint 16 also comprises a channel therein which partially defines the first pressure conduit 34, and in this example, a second section of tubing is connected to the channel in the slick joint 16 to further define the first pressure conduit 34.

The first pressure source may be located at a surface location, e.g., on the topsides of a vessel or on a rig. The surface location may be any location that is not downhole. In some examples, the first pressure source may be a pump or compressor which may be attached (e.g., temporarily attached) to the first pressure conduit 34 to provide an increase in pressure at the first pressure port 32, and therefore increase the pressure at a location inside the hanger engagement arrangement 26. The first pressure source may be attached to the first pressure conduit 34 while the hanger running tool 10 is at a surface location, and then disconnected in order to run the hanger running tool 10 into a desired position (e.g., disconnected before running the hanger running tool 10 into the desired position).

In addition to the first pressure conduit 34, in this example there is also illustrated a second vent conduit 36. The second vent conduit 36 connects to a second pressure port 38 that is also located on an outer surface of the base component 28 (similar to the case with the first pressure port 32). The base component 28 again comprises a channel that provides pressure communication between the hanger engagement arrangement 26 and the second pressure port 38. The second vent conduit 36 is coupled to the second pressure port 38 and extends from the second pressure port 38 to a location above the slick joint 16, thereby providing that the second pressure port 38 is not affected by pressure changes occurring below the slick joint. The second pressure port 38 may function to allow for the venting of fluid from inside the anchoring actuator 42. The second pressure port 38 may in particular permit the venting of fluid from inside an actuation cavity 40 of the anchoring actuator 42. As is the case with the first pressure conduit 34, the second vent conduit comprises a valve 36*a* (e.g., a pilot valve) which may assist in the venting of fluid inside the hanger engagement arrangement 26.

Similar to the first pressure conduit 34, the second vent conduit 36 may be partially defined by sections of tubing, partially defined by the slick joint 16, and partially defined by the tubular 12. A detailed description will not be repeated for the sake of brevity.

Illustrated in the example of FIG. 1 is a first auxiliary port 32*a* and a second auxiliary port 38*a*. Unlike the first pressure port 32, the first auxiliary port 32*a* does not comprise a conduit connected thereto or in communication therewith. In use, the first auxiliary port 32*a* may serve only as a testing port, for example, to perform pressure tests when the hanger running tool 10 is located at a surface location. Once in a downhole location, the first auxiliary port 32*a* may be sealed or blocked and may therefore no longer function. This is similarly the case for the second auxiliary port 38*a*, which may also serve only as a testing port, and may also be sealed, blocked, or plugged during normal operation so that it no longer functions.

There may in some cases be a valve arrangement or removable plug in, or adjacent, either or both of the first and second auxiliary ports 32*a*, 38*a* to permit quick access to the first and second auxiliary ports 32*a*, 38*a* if required. This access component (e.g., a valve or a removable plug, or an arrangement comprising a plurality of either or both) may be situated in or between the relevant first and second auxiliary port 32*a*, 38*a* and the relevant conduit 34, 36.

Additionally illustrated in FIG. 1 is a pressure-controlled anchoring actuator 42 for actuating an anchoring arrangement. As can be seen in FIG. 1, the pressure-controlled anchoring actuator 42 is located on an exterior surface of the hanger running tool 10, peripheral to the central bore 30, and is therefore open to the pressure external to the hanger running tool 10. The pressure external to the hanger running tool 10 may be the pressure of the wellbore, where the hanger running tool 10 is located in or adjacent the wellbore and/or wellhead, or may be the pressure inside the BOP. By providing a seal at the slick joint 16, a user may be able to increase the pressure external to the hanger running tool 10, located below the slick joint 16, to actuate the pressure-controlled anchoring actuator 42. The anchoring arrangement in this example may be considered to comprise at least the actuation sleeve 22 and the engagement profile 24

In order to increase the pressure below the slick joint 16, the user may increase pressure through a conduit such as a choke/kill line which, although not illustrated, may bypass the slick joint 16, and permit a pressure increase below the slick joint 16 for actuating the anchoring actuator 42.

The pressure-controlled anchoring actuator 42 has the shape of an annular piston in this example and comprises a laterally extending shoulder which defines an actuation surface 42*a*. The radially and axially extending shoulder and defined actuation surface 42*a* may function to provide an axially directed force on the pressure controlled anchoring actuator 42 when the pressure in the wellbore, BOP etc. is increased. As illustrated in FIG. 1, the axially directed force acts in a downwards direction, towards the tubing hanger 14, in this example. The pressure-controlled anchoring actuator 42 extends along the exterior of one axial end and along part of the length of the hanger running tool 10, and together with the actuation sleeve 22 of the tubing hanger 14, may function to provide an outer housing for the hanger running tool 10.

Illustrated in FIG. 1, the anchor engagement profile 24 is in a disengaged position, with the engagement profile 24 being radially withdrawn, away from an adjacent anchor point, such as a wellhead, BOP, Xmas tree, or the like, and which may comprise an anchor profile to assist in providing an anchored connection therewith. In order to move the anchor engagement profile 24 to an engaged position, the actuation sleeve 22 of the tubing hanger 14 may be axially moveable. In this example, as the actuation sleeve 22 moves in the direction towards the main body portion 20 of the tubing hanger 14, part of the actuation sleeve 22 may be forced underneath (e.g., radially inwards relative to) the anchor engagement profile 24, thereby forcing the anchor engagement profile 24 in a radially outward direction and into engaging contact with the anchor point, thereby holding the tubing hanger 14 in position in the wellbore, BOP, Xmas tree, or the like. In order to facilitate such a movement, the actuation sleeve 22 may comprise a mating profile, such as a wedge-shaped portion, that is located adjacent the anchor engagement profile 24, so that axial movement of the actuation sleeve 22 provides a force incident on the anchor engagement profile 24 with a force component that is radially outwardly directed. The anchor engagement profile 24 may additionally or alternatively comprise a mating profile, such as a corresponding wedge shaped portion, equally to assist in providing a radially outwardly directed force on the anchor engagement profile 24. In the case where both the actuation sleeve 22 and the anchor engagement profile 24 comprise a wedge shape profile, the profiles may be functional, for example, the profiles may function to provide that the actuation sleeve 22 is able to exert a radially directed force component on the engagement profile 24, thereby moving the engagement profile 24 to a radially outer position.

The anchor engagement profile 24 and/or sleeve 22 may comprise a surface which is configured to maximize the level of grip between the anchor engagement profile 24 and the anchor point. The anchor engagement profile 24 may, for example, be roughened or comprise protrusions such as ribs, dimples, teeth or the like.

As illustrated in FIG. 1, the actuation sleeve 22 may be in contact with the pressure-controlled anchoring actuator 42, or may be contactable via the pressure-controlled anchoring actuator 42, or may be coupled thereto. An increase in the external pressure (e.g., the wellbore or BOP pressure) surrounding the hanger running tool 10 may here have the effect of moving the anchoring actuator 42 in an axially downwards direction as in the illustrated orientation, thereby also moving the actuation sleeve 22 of the tubing hanger 14, and configuring the anchor engagement profile 24 from the disengaged to the engaged position. In some examples, the actuation sleeve 22 (or at least a part of the actuation sleeve 22) may form part of the hanger running tool 10, while the anchor engagement profile 24 forms part of the tubing hanger 14.

Although not illustrated, the hanger running tool may comprise a sensor or sensor arrangement for identifying whether a piston, actuation sleeve, engagement profile, or the like has performed the desired movement. The sensor may be in the form of a pressure sensor, strain gauge, optical sensor, or any other type of sensor that is appropriate to identify the movement of a piston. The sensor or sensor arrangement may be connected to a control arrangement (e.g., by wires extending between the sensors and control arrangement, or by a wireless connection). The control arrangement may be located at a surface location, or on a drill string or downhole, and the control arrangement may be connected to a display to alert a user to the status of movement of a (or each) piston in the hanger running tool 10.

Inside the central bore 30 is illustrated a sleeve 44 in this example, the sleeve 44 comprising a valve seat 46 which in this example is partially located inside the hanger running tool 10 and partially located inside the hanger 14. The sleeve 44 may be run into the well bore with the hanger running tool 10, or may be positioned separately in the hanger running tool 10, for example, before or after the hanger running tool 10 has been installed in the desired position. The sleeve 44 may, for example, be run in on a wireline, and may be able to be retrieved or replaced if required. In some examples, the sleeve may have a profile different to that illustrated in FIG. 1, for example, where the sleeve is run in on a wireline into the hanger running tool 10, the profile may be different to cases where the sleeve is preinstalled. In addition, or alternatively, a hanger plug may be run into the tubing hanger 14, for example, to restrict or block pressure surges from below the tubing hanger 14, by allowing the user to simply run such a plug through the central bore 30 of the hanger running tool 10. It may be possible in some examples to preinstall a plug into the tubing hanger 14 as the tubing hanger 14 is run downhole, thereby removing the need to install the plug once the hanger is in position in the BOP or wellhead.

The illustrated sleeve 44 (which may be a retrievable sleeve), or a hanger plug, or other sealing member or collection of members may be considered to be a pressure sealing arrangement. The pressure sealing arrangement (e.g., the sleeve 44 or hanger plug, or pressure sealing object) may function to facilitate use of the hanger running tool 10. In the case of the sleeve 44, by providing a valve seat 46, the sleeve 44 may be able to provide a seal in the central bore 30 of the hanger running tool 10, for example, by dropping a ball into the hanger running tool 10. In the case of a hanger plug (e.g., a removable hanger plug), or another sealing member or members which may be positioned in the central bore 30 in order to provide a pressure seal therein, the hanger plug may be lowered into and positioned in the central bore 30, and optionally removed thereafter. The pressure sealing arrangement may in some cases be positioned fully or partially in the central bore 30 defined by the tubing hanger 14. In providing a pressure sealing arrangement, a user may be able to provide a first and a second region of differing pressure located above and below the pressure sealing arrangement. For example, by increasing the pressure in the central bore 30 at a surface location, a user may be able to increase the pressure in the first region to an actuation pressure for actuating the actuator 55, while the second (e.g., lower) region remains at a different (e.g., lower) pressure, thereby allowing the user to actuate the actuator 55 without having to pressurize the entire conduit. The user may therefore be able to provide an increase in pressure inside the central bore 30 of the hanger running tool 10 above the valve seat in the direction towards the surface. An increase in pressure may be provided by increasing the pressure inside the tubular 12 (e.g., the marine riser, tubular riser, subsea riser, control riser, or the like) to which the hanger running tool 10 and the tubing hanger 14 are connected. It should be noted that, although the pressure sealing arrangement may facilitate pressurization of the central bore 30 of the hanger running tool 10 to an actuation pressure, actuation of the actuator 55 may be achieved without the requirement for the pressure sealing arrangement. It may be possible, for example, to simply increase the pressure from, for example, the connected riser to the wellbore without the requirement for the pressure sealing arrangement, equally having the effect of actuating the actuator.

The sleeve 44 may also function to block and seal a production port (not illustrated) in the tubing hanger 14, thereby providing that operation of the hanger running tool 10 is not affected by unsealed ports in the tubing hanger 14, if these ports are not yet in use.

Figure 2:
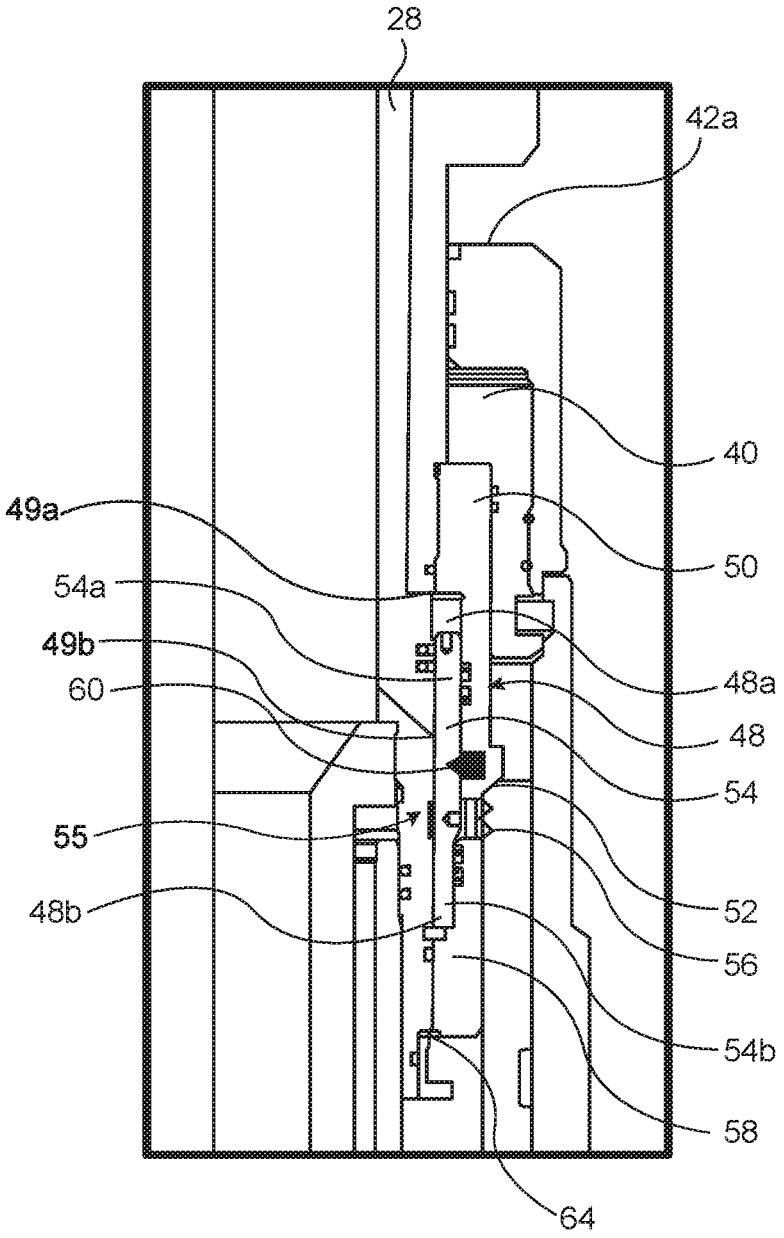
FIG. 2 shows Detail A of the hanger running tool in greater detail.

Illustrated in FIG. 2 is Detail A of FIG. 1, which is a section of internal detail of the hanger engagement arrangement 26 shown in greater detail.

As can be seen in FIGS. 1 and 2, a channel extends from the first pressure port 32, and through the base component 28 of the hanger running tool 10 to a location inside the hanger running tool 10 (see also FIG. 1). A hydraulic chamber arrangement 48 is formed inside the hanger running tool 10 between the base component 28, a lower annular ring 58, and an upper annular engagement ring 50, which may comprise an abutment surface 52 for the purposes of engaging and/or locating the hanger running tool 10 relative to the tubing hanger 14. Inside the hydraulic chamber arrangement 48 is located an annular piston 54 which comprises a thicker end 54*a* and a thinner end 54*b* defining two separate (an upper and a lower) hydraulic chambers 48*a*, 48*b* inside the hydraulic chamber arrangement 48. Together, the annular piston 54 inside the hydraulic chamber arrangement 48 may form an actuator 55 (e.g., a pressure actuated actuator). The thicker end 54*a* of the annular piston 54 is located above the thinner end 54*b* in this example so that the thicker end 54*a* is located in an upper hydraulic chamber 48*a*, while the thinner end 54*b* is located in a lower hydraulic chamber 48*b*. While the annular piston 54 of this example comprises a thicker end 54*a* and a thinner end 54*b*, in some examples the annular piston 54 can, for example, be a balanced piston, with the thicker end 54*a* having the same radial width as the thinner end 54*b*, and, for example, with the annular piston 54 having a constant radial width along its length.

The actuator 55 comprises two pressure ports (a first and a second pressure port), which may be considered to be pressure inlets (a first and a second pressure inlet). The first pressure inlet 49*a* permits a pressure communication with the upper hydraulic chamber 48*a*, and in this example is connected to the first pressure conduit which leads to a location above the slick joint 16. The first pressure inlet 49*a* may optionally be connected to the first pressure conduit 34 via the channel in the base component 28, or the first pressure conduit 34 may be connected directly to the first pressure inlet 49*a*. As previously described, the first pressure conduit 34 may be connected to a first pressure source to expose the upper hydraulic chamber 48*a* to the pressure of the first pressure source. The second pressure inlet 49*b* permits a pressure communication with the lower hydraulic chamber 48*b*, and in this example is connected to a bore pressure channel 62 so that the lower hydraulic chamber 48*b* is in a pressure communication with the central bore 30. The actuation pressure for actuating (e.g., moving) the actuator to a disengaged position from an engaged position in order to disengage the hanger engagement member 56 is therefore dependent on the pressure inside the upper hydraulic chamber 48*a* and at the first pressure inlet 49*a*.

Although not illustrated, and similar to as previously described, a sensor or sensor arrangement may be located on or adjacent the annular piston 54 and/or the hydraulic chamber arrangement 48 so as to identify a movement of the annular piston 54, and to send information on the positioning of the annular piston 54 to a user.

Located immediately below the upper annular engagement ring 50 is a hanger engagement member 56, comprising an engagement profile for engaging the hanger running tool 10 with the tubing hanger 14. The hanger engagement member 56 is held in place by the lower annular ring 58. An upper seal arrangement is additionally provided between the thicker end 54*a* of the annular piston 54, the base component 28, and the upper annular engagement ring 50, while a lower seal arrangement is provided between the thinner end 54*b* of the annular piston 54, the base component 28, and the lower annular ring 58. The upper annular engagement ring 50 additionally comprises a lock key 60, which may be spring loaded, and which may engage with the annular piston 54 in order to lock the annular piston 54. As shown in Detail A, the annular piston 54 is in a position so that the hanger engagement member 56 is in contact with the tubing hanger 14, thereby engaging the hanger running tool 10 with the tubing hanger 14, and locking it in this position.

In use, the hanger running tool 10 may be coupled (e.g., attached, engaged) to the tubing hanger 14 at a surface location, for example, on a vessel, a rig, in a warehouse etc. To do so, a first pressure source, which may be in the form of, or provided by, a pump or compressor, is attached to the first pressure conduit 34 so as to provide an increase in pressure in the upper hydraulic chamber 48*a*, i.e., the end of the hydraulic chamber at which the thicker end 54*a* of the annular piston 54 is located. The increase in pressure on in the upper section of the hydraulic chamber causes the annular piston 54 to move in a downwards direction. As the annular piston 54 moves in a downwards direction, the hanger engagement member 56 changes from being in contact with the thinner end 54*b* of the annular piston 54 to being in contact with the thicker end 54*a* thereof, thereby having the effect of moving the hanger engagement member 56 from a disengaged position to an engaged position relative to the tubing hanger 14.

The hanger engagement member 56 may be biased, for example, spring loaded, towards the disengaged position in order to avoid an undesired engagement with the tubing hanger 14. Once in the engaged position, the lock key 60 may inhibit the movement of the annular piston 54, thereby preventing the hanger engagement arrangement 26 and the hanger running tool 10 from becoming disengaged from the tubing hanger 14, for example, during handling.

Once the hanger running tool 10 and the tubing hanger 14 have been engaged, both may be run into the desired position in the subsea location (e.g., in the BOP, Xmas tree, wellhead, or the like), for example, via a marine riser and BOP. In order to assist with the positioning of the tubing hanger 14, an arrangement of sensors may be used, for example, sensors which are able to convey to a user that the tubing hanger has passed a certain point in the BOP, has come into engagement with the wellhead, for example, a direct engagement or an indirect engagement (e.g., via a seat on the wellhead, via a casing hanger on the wellhead, via a seat in an Xmas tree engaged with the wellhead, or the like), or has reached some other desired position. The positioning of the tool may additionally or alternatively be confirmed by hydraulic means, for example, by having a tool in the hanger running tool 10 or the tubing hanger 14 that is able to measure a pressure buildup around the tool as it is lowered into position, thereby giving the user an indication of the location of the tubing hanger 14. This information may be passed to a user at a surface location by any appropriate means, for example, by communication wires or fibers attached to a marine riser, by wireless transmission, or the like.

With the tubing hanger 14 in the desired position, it may then be necessary to install the tubing hanger 14 in this position. The tubing hanger 14 and the hanger running tool 10 will initially be in the position shown in FIG. 1. In this position, the anchor engagement profile 24 is in a retracted configuration and is not engaged with the anchor point or any surrounding component of the Xmas tree, BOP, wellhead, or the like. In order to engage the tubing hanger 14 with the anchor point (e.g., of the wellhead, BOP, Xmas tree), it is necessary to configure the tubing hanger 14 and the hanger running tool 10 to the engaged position as shown in FIG. 2. The pressure-controlled anchoring actuator 42 is here moved in a downward direction. As the anchoring actuator 42 is in contact with the actuation sleeve 22, this has the effect of moving the anchor engagement profile 24 to the engaged, radially expanded, configuration, as previously described, in which it is in engagement with an anchor point. Movement of the anchoring actuator 42 may be enabled by increasing the pressure in the wellbore, the Xmas tree, the BOP, or the like (e.g., via a choke/kill line that bypasses the slick joint 16). This may be achieved by moving a ram or BOP annular preventer into sealing contact with the slick joint 16, and then increasing the pressure below the slick joint 16.

It can be seen in both FIGS. 1 and 2 that an actuation cavity 40 exists between the anchoring actuator 42 and the base component 28. A sealing arrangement may be in place between the anchoring actuator 42, the base component 28, and the upper annular engagement ring 50 so as to isolate the pressure in the actuation cavity 40 from the rest of the hanger actuation arrangement 26 (e.g., from the hydraulic chamber arrangement 48, as will be described in the following paragraphs).

A sensor or sensor arrangement may be located on or adjacent the anchoring actuator 42 so as to provide an indication of the status thereof. The sensor or sensor arrangement may be located on at least one of the anchoring actuator or tool body (e.g., the base component 28) adjacent the anchoring actuator 42. The sensor or sensor arrangement may in some examples be affixed or connected directly to the anchoring actuator 42, base component 28 etc., while in other examples, the sensor or sensor arrangement may be provided as a separate component which may be affixed or connected to the anchoring actuator 42, base component 28, any other adjacent component etc.

As illustrated in both FIGS. 1 and 2, the second pressure port 38 leads to a channel in the base component 28 that permits a pressure communication between the actuation cavity 40 and second pressure port 38. Since the second pressure port 38 is coupled to the second vent conduit 36, the second vent conduit 36 thereby extending to a position located above the slick joint 16, the pressure in the actuation cavity 40 will then be equal to the pressure in the region above the slick joint 16, which may be equal to the pressure inside the marine riser. Once the sealing ram is placed in sealing contact with the slick joint 16, and the pressure below the slick joint is increased, there will therefore then be an unbalanced force acting upon the anchoring actuator 42, on the laterally extending shoulder and actuation surface 42*a* thereof, as a result of the pressure differential between the actuation cavity 40 and the region external to the anchoring actuator 42. This causes the anchoring actuator 42 to move in a downwards direction, causing the anchor engagement profile 24 to engage the anchor point, and the tubing hanger 14 to be installed in the desired position. At the same time, the contents of the actuation cavity 40 may be vented via the second vent conduit 36 to a location above the slick joint 16. The valve 36*a* in the second vent conduit 36 may permit some degree of control over the venting of the actuation cavity 40. The valve 36*a* may, for example, be operable by a user, to open only when desired by a user. The valve may additionally or alternatively automatically open, for example, at a set pressure limit.

While the term "above" is used to describe relative terms, this term has been selected to assist the reader in understanding the present invention in the context of the provided drawings. While the described components may be provided in the orientation shown in the drawings, it may also be possible to provide the described components in other configurations, for example, rotated by 90 degrees, 45 degrees, or some other angle. The reader should therefore understand that in such cases, the term "above" (and equally, similarly descriptive relative terms such as "below", "upwards" and "downwards") may differ in meaning from what is conventionally understood.

Once the tubing hanger 14 has been installed in the desired position, it may be necessary to unlock the hanger running tool 10 from the tubing hanger 14 for retrieval. To perform this operation, the pressure sealing arrangement (e.g., sleeve 44 as in FIG. 1, or a hanger plug, or other arrangement) may be installed (or may be preinstalled) in the hanger running tool 10, and where necessary, an activation object such as a ball or dart may be dropped into the valve seat 46 in the sleeve. The ball (not shown) creates a seal with the valve seat of the sleeve 44, or a hanger plug, or any other pressure sealing arrangement, creates a seal in the central bore 30, and the pressure inside the hanger running tool 10 may be increased above the valve seat 46, hanger plug, other pressure sealing arrangement, or the like. A first and a second pressure region may therefore be established inside the central bore 30. The increase in pressure above the pressure sealing arrangement (e.g., the first pressure region thereof) may be achieved by increasing the pressure in the tubular 12 attached to the hanger running tool 10. As can be seen in FIG. 1, the bore pressure channel 62 (or a plurality of circumferentially arranged channels) extends between the central bore 30 and the actuator 55 defined by the hydraulic chamber arrangement 48 and the piston 54. The bore pressure channel 62 is here located (and may be defined by) in the base component 28, allowing a pressure communication between the central bore 30 and the hydraulic chamber arrangement 48 of the actuator. The bore pressure channel 62 in particular permits a pressure communication between a lower hydraulic chamber 48*b* that is located below (in this example) the upper seal arrangement and comprises a fluid port in the central bore 30 that is located above the level of the pressure sealing arrangement, e.g., the valve seat, hanger plug, or the like. With the pressure sealing arrangement in place (e.g., the activation object—in this example, the ball—engaged in the valve seat 46), an increase in pressure of the central bore 30 acts on the lower seal arrangement in the lower hydraulic chamber 48*b*, having the effect of pushing the annular piston 54 therein in an upwards direction once the pressure in the central bore 30 reaches an actuation pressure, and overcoming the locking force of the lock key 60, as provided by a biasing member such as a spring, the spring biasing the lock key 60 towards the locked configuration, and also overcoming the pressure in upper hydraulic chamber 48*a*, which is equal to the pressure above the slick joint 16, in this example via the first pressure conduit 34. While only one lock key 60 is illustrated in this position, more than one lock key may be present (e.g., there may be a circular array of individual lock keys). A simple profile of the lock key is illustrated in Detail A, although a differing, more complex, profile may be used in other examples (e.g., a profile comprising multiple teeth). The lock key 60 in this example is supported by a spring so that it is able to disengage upon application of a laterally directed force. Depending on the differing operational conditions (e.g., differing depths or operating pressures at which the tubing hanger running tool is used), the lock key may be differently designed to provide that an accidental unlatching of the hanger running tool 10 from the hanger 14 does not occur given the specific operating conditions. For example, more or fewer lock keys 60 may be used, the spring stiffness may be variable, and/or the engagement profile may have a varying shape (e.g., a varying number of teeth). These variables may be able to be controlled to provide an arrangement requiring a desired minimum level of laterally directed force to unlatch.

As a result of the seal arrangements in the hanger running tool 10, and the pressure balance within cavities/chambers in the hanger running tool 10, the hanger running tool 10 may be relatively unaffected by external pressures and/or differential pressures acting across the hanger running tool 10. To the extent the pressure acting on both ends of the annular piston 54 is the same (i.e., both ends are open to the pressure surrounding the hanger running tool 10), this will act to prevent an accidental actuation of the tubing hanger running tool 10 during installation.

As the annular piston 54 moves in an upwards direction, the hanger engagement member 56 comes into contact with the thinner end 54*b* of the annular piston 54. As the hanger engagement member 56 is biased towards the disengaged configuration, the hanger engagement member 56 moves towards the disengaged configuration, and the hanger running tool 10 is now disengaged from the tubing hanger 14. The hanger running tool 10 may then be retrieved.

To further assist in moving the annular piston 54 towards a disengaged position, the valve 34*a* in the first pressure conduit 34 may be opened so as to permit a venting of the upper hydraulic chamber 48*a*.

The tool may also have a secondary means of operation, so that the hanger running tool 10 is able to be released from tubing hanger 14 in the case that the above-described process should fail. In the example of FIGS. 1 and 2, the hanger running tool 10 may comprise a shear ring 64. The shear ring is here located between the base component 28 and the lower annular ring 58, and immediately above the shear ring 64 on the base component 28 may be a threaded profile which is configured to engage with a threaded profile of the lower annular ring 58.

The base component 28 may be rotated in order to release the tubing hanger 14 from the hanger running tool 10. The lower annular ring 58 may be in engagement with the sleeve located radially outwardly thereof (e.g., engaged by a key located therebetween), and therefore may not rotate with the base component 28, thereby causing the shear ring 64 to shear. Once the shear ring 64 is sheared, then the rotation between the lower annular ring 58 and the base component 28 may cause the lower annular ring 58 to move in a downwards direction, as a result of the threaded connection therebetween, until the lower annular ring 58 and the base component 28 are disengaged. The base component may at this point be pulled in an upward direction, causing the annular piston 54 to move in an upwards direction and the hanger running tool 10 to be disengaged from the tubing hanger 14, and allowing retrieval thereof. The hanger running tool 10 may be retrievable using this method should the primary method of hydraulic actuation fail.

Although one means of secondary operation is described, it should be noted that a user should not be restricted specifically to this means of secondary operation. Other means of secondary operation may equally be possible for use in combination with the hanger running tool 10 and tubing hanger 14 as described.

Figure 3:
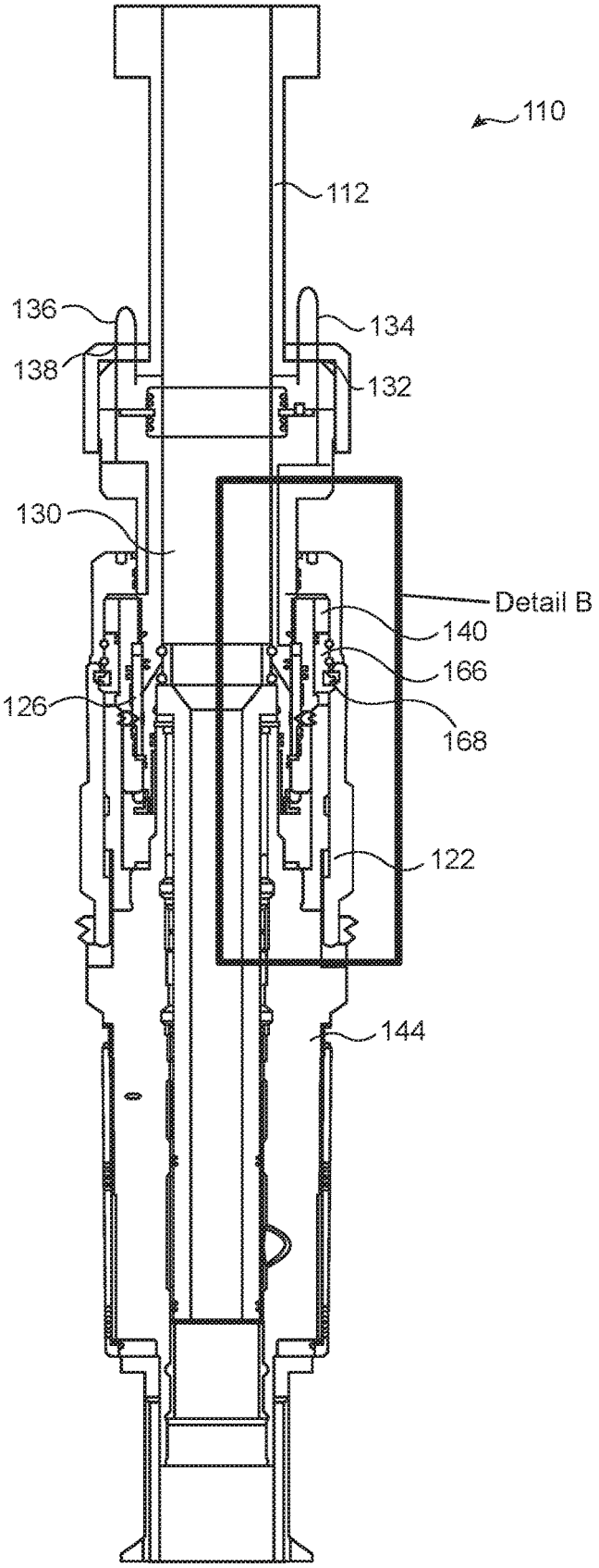
FIG. 3 shows a hanger running tool in a retrieval configuration having a retrieval module attached.
Figure 4:
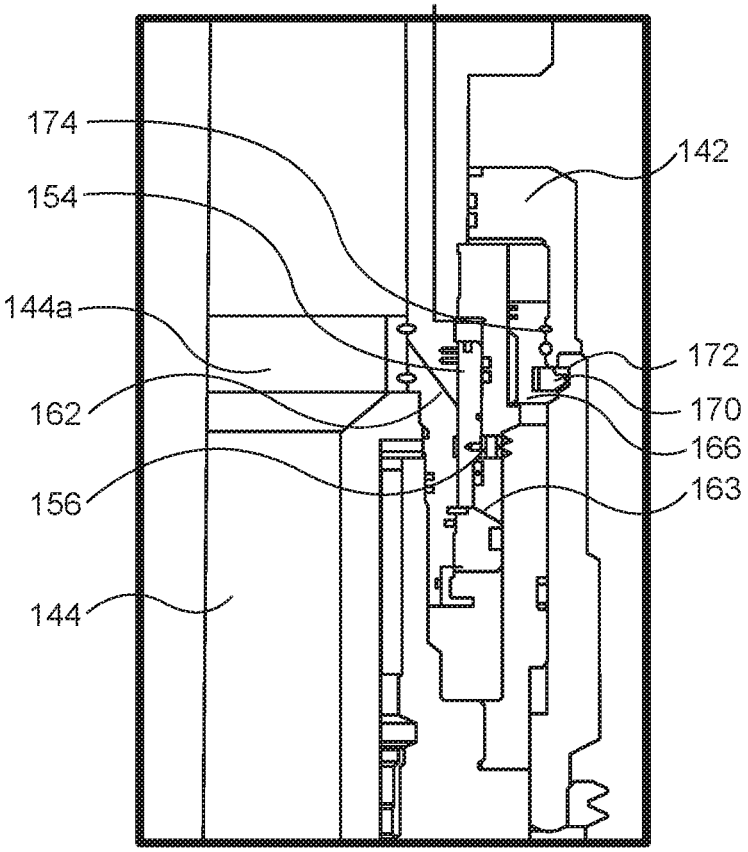
FIG. 4 shows Detail B of the hanger running tool in greater detail.

FIGS. 3 and 4 illustrate a further example of a section of a hanger running tool 110, which may be the same tool as described in FIGS. 1 and 2, but in a different configuration as will be described. Detail B illustrates a part of FIG. 3 in larger detail. The hanger running tool 110 is substantially similar to that illustrated in FIGS. 1 and 2, and therefore equivalent numbering will be used for equivalent parts, augmented by 100.

There is a detachable retrieval module 166 in the example of FIG. 3. In this example, the detachable retrieval module 166 is attached to the hanger running tool 110 between the anchoring actuator 142. The detachable retrieval module 166 may be attached to the hanger running tool 110 before running downhole.

The detachable retrieval tool comprises a biasing member 168 (which may be in the form of a snap ring or of spring-loaded keys) which may be moveable between a radially inner position and a radially outer position, and which may be biased towards the radially outer position, e.g., by a spring member. As can be seen, the biasing member 168 (in this case a snap ring) comprises a lip 170 which is able to engage with a corresponding lip 172 of the actuation sleeve 122. The hanger running tool 110 may be positioned using electronic or hydraulic sensors, as previously described. As the snap ring 168 can be moved between a radially inner position and a radially outer position, the snap ring 168 may effectively be collapsed and then expanded so as to engage with the lip 172 of the actuation sleeve 122.

The pressure above the pressure sealing arrangement may be increased in order to configure the anchoring arrangement to the disengaged position via the second vent conduit 136, which has been rerouted as described below.

Once engaged with the lip 172 of the actuation sleeve 122, the hanger running tool 110 may be pulled in an upwards (e.g., upwards relative to the orientation of the drawings) direction, thereby completing the disengagement process of the tubing hanger 114 from the anchor point. Before the tubing hanger 114 may be retrieved from the wellbore, the hanger running tool 110 is engaged with the tubing hanger 114 via the hanger engagement member 156.

It should be noted that, in the examples of FIGS. 3 and 4, the first pressure conduit 134 and the second vent conduit 136 have been rerouted so that they connect the respective part of the hanger engagement arrangement 126 (as described in relation to the previous drawings) to the inside of the tubular 112, which is in pressure and fluid communication with the central bore 130 of the hanger running tool 110. As such, the pressure inside the hanger running tool 110 may be increased in order to provide a pressure increase at the first pressure port 132 and the second pressure port 138, thereby moving the annular piston 154 in a downwards direction and engaging the hanger engagement member 156 with the hanger 114. In this example, there may therefore be no requirement for a dedicated fluid source in order to operate the hanger running tool 110 because the pressure inside the hanger running tool 110 (or, for example, the BOP) may be increased in order to move annular piston 154 in a downwards direction. In order to facilitate a downwards movement of the annular piston 154, a port and flowline 163 is illustrated in Detail B of the hanger running tool 110 to allow for a venting of the lower hydraulic chamber 148*b*. The pressure inside the actuation cavity 140 is similarly increased, causing the anchoring actuator 142 to move in an upwards direction and thereby also assisting the disengaging of the hanger running tool 110 from the hanger 114. A sealing arrangement 174 is provided between the detachable retrieval module 166 and the anchoring actuator 142 in order to form the pressure sealed actuation cavity 140, the pressure in which may be increased/decreased via the second pressure port 138 (it should be noted that this sealing arrangement may also be present in the tool 10 in the installation configuration).

Although not illustrated, at least one (or both) of the first pressure conduit 134 and the second vent conduit 136 may comprise a pilot valve, similar to that as described in relation to FIG. 1.

It should also be noted that the sleeve 144, when the hanger running tool 110 is in the retrieval configuration, comprises an additional sealing ring 144*a*, which has the effect of isolating the port 162 from the central bore 130. When providing a pressure increase at the ports 132 and 138, there will therefore not be a corresponding pressure increase at the port 162. The sealing ring 144*a* may be a separate component, or may be integrally formed with the sleeve 144, or may be a separate component. The sealing ring 144*a* may be coupled to the sleeve 144, e.g., via a mating or threaded profile.

A further upwards movement of the tubing hanger 114 may then have the effect of retrieving the tubing hanger 114 from the wellbore. Having such a retrieval module provides a straightforward way of retrieving the tubing hanger 114, without the need for use of complex positioning maneuvers to retrieve the tubing hanger 114.

The person skilled in the art will realize that the present disclosure is not limited to the preferred embodiments described above. The person skilled in the art further realizes that modifications and variations are possible within the scope of the appended claims. Variations to the disclosed embodiments can also be understood and effected by the skilled person in practicing the claimed disclosure from a study of the drawings, the disclosure, and the appended claims.

LIST OF REFERENCE NUMERALS

10 Hanger running tool
12 Tubular
14 Tubing hanger
16 Slick joint
20 Main body portion
22 Actuation sleeve
24 Engagement profile
26 Hanger engagement arrangement
28 Base component
30 Central bore
32 First pressure port
32*a* First auxiliary port
34 First pressure conduit
34*a* Valve
36 Second vent conduit
36*a* Valve
38 Second pressure port
38*a* Second auxiliary port
40 Actuation cavity
42 Anchoring actuator
42*a* Actuation surface
44 Sleeve
46 Valve seat
48 Hydraulic chamber arrangement
48*a* Upper hydraulic chamber
48*b* Lower hydraulic chamber
49*a* First pressure inlet
49*b* Second pressure inlet
50 Upper annular engagement ring
52 Abutment surface
54 Annular piston
54*a* Thicker end
54*b* Thinner end
55 Actuator
56 Hanger engagement member
58 Lower annular ring
60 Lock key
62 Bore pressure channel
64 Shear ring
110 Hanger running tool
112 Tubular
122 Actuation sleeve
126 Hanger engagement arrangement
130 Central bore
132 First pressure port
134 First pressure conduit
136 Second vent conduit
138 Second pressure port
140 Actuation cavity
142 Anchoring actuator
144 Sleeve
144*a* Sealing ring
148*b* Lower hydraulic chamber
154 Annular piston
156 Hanger engagement member
162 Port
163 Flowline
166 Detachable retrieval module
168 Biasing member/Snap ring
170 Lip
172 Lip
174 Sealing arrangement

What is claimed is:

1. A hanger running tool for installing a hanger in a well, the hanger running tool comprising:

a central bore;

a hanger engagement arrangement which is configurable between an engaged position in which the hanger engagement arrangement is coupled to the hanger, and a disengaged position in which the hanger engagement arrangement is decoupled from the hanger; and a pressure-controlled anchoring actuator which is configured to actuate an anchoring arrangement provided on the hanger to an anchor point provided in the well, the pressure-controlled anchoring actuator comprising an actuation surface, wherein, the hanger engagement arrangement is configurable to the engaged position in response to an increase in a pressure at a first pressure source, the hanger engagement arrangement is configurable to the disengaged position in response to an increase in a pressure inside the central bore, and the pressure-controlled anchoring actuator is actuated in response to an increase in a pressure on the actuation surface so that the anchoring arrangement anchors the hanger to the anchor point.

2. The hanger running tool as recited in claim 1, wherein the hanger engagement arrangement and the pressure-controlled anchoring actuator are located external to and around a periphery of the central bore.

3. The hanger running tool as recited in to claim 1, further comprising:

a pressure sealing arrangement which is configurable to be positioned in the central bore so as to enable the increase in the pressure in the central bore above a sealing object, wherein, the sealing object provides a first pressure region and a second pressure region in the central bore.

4. The hanger running tool as recited in claim 1, further comprising:

a valve which comprises a valve seat which is arranged in the central bore, wherein, the valve is closeable so as to increase a pressure inside the hanger running tool, and the valve is provided as at least one of a ball valve and a valve that is activated by an activation object.

5. The hanger running tool as recited in claim 4, wherein the valve is configured to be removable from the hanger running tool.

6. The hanger running tool as recited in claim 1, wherein, the hanger engagement arrangement comprises an actuator which comprises a piston which is arranged in a hydraulic chamber arrangement, the hydraulic chamber arrangement being divided into an upper hydraulic chamber and a lower hydraulic chamber, and both the first pressure source and the central bore are configurable to be in a pressure communication with at least one of the upper hydraulic chamber and the lower hydraulic chamber of the hydraulic chamber arrangement.

7. The hanger running tool as recited in claim 1, wherein, the anchoring arrangement comprises an anchor engagement profile, and the pressure-controlled anchoring actuator is configurable to operate the anchoring arrangement so as to engage an anchor point.

8. The hanger running tool as recited in claim 1, further comprising:

a locking arrangement which is configured to lock the hanger engagement arrangement in the engaged position.

9. A method for installing a hanger in a well, the method comprising:

providing a hanger running tool comprising a central bore, a hanger engagement arrangement, and an anchoring actuator which is configured to actuate an anchoring arrangement;

engaging the hanger running tool with the hanger by providing an increase in a pressure at a first pressure source to configure the hanger engagement arrangement to an engaged configuration;

positioning the hanger and hanger running tool in the well at a desired location;

engaging the hanger with an anchor point provided in the well by providing an increase in a pressure in the well to actuate the anchoring actuator so as to engage the anchoring arrangement with the anchor point;

disengaging the hanger running tool from the hanger by providing an increase in a pressure in the central bore to configure the hanger engagement arrangement to a disengaged configuration; and retrieving the hanger running tool from the well.

10. The method as recited in claim 9, further comprising:

providing a valve seat in the central bore; and providing an activation object in the valve seat to restrict a fluid flow through the central bore and to provide the increase in the pressure in the central bore.

11. A hanger running tool for retrieval of a hanger from a well, the hanger running tool comprising:

a central bore;

a hanger engagement arrangement which is configurable between an engaged position in which the hanger engagement arrangement is coupled to the hanger, and a disengaged position in which the hanger engagement arrangement is decoupled from the hanger, the hanger engagement arrangement comprising an actuator comprising a pressure inlet which is in a fluid communication with the central bore, the hanger engagement arrangement being configured to move from the disengaged position to the engaged position in response to an increase in a pressure inside the central bore; and a pressure-controlled anchoring actuator for actuating an anchoring arrangement, the pressure-controlled anchoring actuator comprising an actuation cavity which is in a communication with the central bore and a retrieval module which comprises a retrieval profile for engaging with the anchoring arrangement, the pressure-controlled anchoring actuator being configured so that the pressure-controlled anchoring actuator moves in response to an increase in a pressure inside the central bore so as to cause the anchoring arrangement to release the hanger from an engagement with an anchor point provided in the well.

12. The hanger running tool as recited in claim 11, wherein the hanger engagement arrangement and the anchoring actuator are each arranged external to and around a periphery of the central bore.

13. The hanger running tool as recited in claim 11, further comprising:

a pressure sealing arrangement which is configurable to be positioned in the central bore so as to enable the increase in the pressure in the central bore above a sealing object, wherein, the sealing object provides a first pressure region and a second pressure region in the central bore.

14. The hanger running tool as recited in claim 11, further comprising:

a valve which comprises a valve seat which is arranged in the central bore, wherein, the valve is closeable so as to increase a pressure inside the hanger running tool, and the valve is provided as at least one of a ball valve and a valve that is activated by an activation object.

15. The hanger running tool as recited in claim 11, wherein the hanger engagement arrangement further comprises an actuator which comprises a piston which is arranged in a hydraulic chamber arrangement, the hydraulic chamber arrangement being divided into an upper hydraulic chamber and a lower hydraulic chamber, wherein, the central bore is in a pressure communication with at least one of the upper hydraulic chamber and the lower hydraulic chamber of the hydraulic chamber arrangement.

16. The hanger running tool as recited in claim 15, further comprising:

a pressure port which extends between the lower hydraulic chamber and the central bore; and a sealing ring which is configured to block the pressure port so as to isolate the pressure port from the central bore.

17. A method for retrieving a hanger from a well, the method comprising:

a first step of providing a hanger running tool comprising a central bore, a hanger engagement arrangement, and an anchoring actuator for actuating an anchoring arrangement;

a second step of positioning the hanger running tool in the well adjacent to and above the hanger;

a fourth step of facilitating a disengagement of the hanger from an anchor point provided in the well by providing an increase in a pressure in the central bore to actuate the anchoring actuator so as to disengage the anchoring arrangement from the anchor point and engaging the hanger running tool with the hanger by providing the increase in the pressure in the central bore of the hanger running tool so as to configure the hanger engagement arrangement to the engaged configuration;

a fourth step of retrieving the hanger running tool and hanger from the well.

18. The method as recited in claim 17, further comprising:

providing a valve seat in the central bore; and providing an activation object in the valve seat to restrict a fluid flow through the central bore and to provide the increase in the pressure in the central bore.

19. The method as recited in claim 17, further comprising:

installing a retrievable plug in the well by running the retrievable plug through the central bore of the hanger running tool.

20. The method as recited in claim 17, wherein, the hanger engagement arrangement of the hanger running tool comprises an actuator which comprises a piston which is arranged in a hydraulic chamber arrangement, the hydraulic chamber arrangement being divided into an upper hydraulic chamber and a lower hydraulic chamber, a first pressure conduit extends to the upper hydraulic chamber, a second pressure conduit extends between the lower hydraulic chamber and the central bore, and prior to positioning the hanger running tool in the well adjacent and above the hanger, the method further comprises:

connecting the first pressure conduit to the central bore; and positioning a sealing ring in the central bore so as to isolate the second pressure conduit from the central bore.

* * * * *